US008387379B2

(12) United States Patent
Liu

(10) Patent No.: US 8,387,379 B2
(45) Date of Patent: Mar. 5, 2013

(54) ELECTRICITY GENERATION DEVICE USING HOT GAS ENGINE

(75) Inventor: Kuo-Shen Liu, Taipei (TW)

(73) Assignee: Houly Co., Ltd., Taipei (TW)

( * ) Notice: Subject to any disclaimer, the term of this patent is extended or adjusted under 35 U.S.C. 154(b) by 861 days.

(21) Appl. No.: 12/499,103

(22) Filed: Jul. 8, 2009

(65) Prior Publication Data

US 2011/0005219 A1 Jan. 13, 2011

(51) Int. Cl.
*F01K 21/04* (2006.01)
*F02G 1/04* (2006.01)

(52) U.S. Cl. ..... 60/511; 60/508

(58) Field of Classification Search ..... 60/508, 60/511, 512, 514, 515, 650, 495–507, 641.6, 60/641.7

See application file for complete search history.

(56) References Cited

U.S. PATENT DOCUMENTS

| | | | | | |
|---|---|---|---|---|---|
| 411,605 | A * | 9/1889 | McTighe | ..... | 60/511 |
| 2,391,078 | A * | 12/1945 | Thomsen | ..... | 60/526 |
| 3,896,622 | A * | 7/1975 | Daniello | ..... | 60/641.7 |
| 3,905,195 | A * | 9/1975 | Gregory | ..... | 60/512 |
| 4,195,481 | A * | 4/1980 | Gregory | ..... | 60/516 |
| 6,272,855 | B1 * | 8/2001 | Leonardi | ..... | 60/513 |

* cited by examiner

*Primary Examiner* — Kenneth Bomberg
*Assistant Examiner* — Christopher Jetton

(57) ABSTRACT

The present invention provides an electricity generation device using hot gas engine. The device contains a closed container filled with high-pressure gas. The container has an outlet which is connected to a pneumatic or hydraulic cylinder. Hot and cold fluids are sprayed alternatively and repeatedly into the closed container to heat up or cool down the high-pressure gas. As the high-pressure gas expands or contracts, a piston rod of the cylinder is pushed and pulled back and forth so as to produce electricity continuously.

9 Claims, 4 Drawing Sheets

ELECTRICITY GENERATION DEVICE USING HOT GAS ENGINE

(a) TECHNICAL FIELD OF THE INVENTION

The present invention generally relates to an electricity generation device using a hot air engine, and especially relates to one such device that involves a low grade-temperature heat source and has a simplified structure and a low production cost so as to achieve economical electricity generation.

(b) DESCRIPTION OF THE PRIOR ART

As the fossil fuel is about to be depleted, effectively utilizing wasted heat and recycling heat source into new energy have become increasingly important. Wasted heat usually has a temperature below 200° C., a solar water heater has a temperature below 80° C., an ordinary hot spring has a temperature below 70° C., deep sea water has a temperature difference with surface about 15° C., exhaust water from a thermal or nuclear power plant has a temperature difference with surface about 12° C., icy water (or saline water) in a snowing area has a temperature different from the environment for about 10° C. All these heat sources could be utilized for electricity generation. However, the heat source for thermal power generation has a temperature about 500° C., so the conventional thermal power generation means is obviously not appropriate to apply to the foregoing heat sources as their temperatures are too low grade.

A hot air engine is an engine which uses the expansion and contraction of an internal gas under the influence of a temperature change to convert thermal energy into mechanical work. The most representative hot air engine is the Stirling engine whose advantage is that any heat source could be used to create the temperature difference. However, as the internal gas has a low thermal conductivity coefficient, the heat conduction efficiency is therefore limited. For example, if solar power is to be utilized as heat source, the sun light has to be focused to create a high temperature above 700° C. and the internal pressure has to be 20 Mpa (200 atm) so as to achieve the required heat conduction efficiency. As such, the utilization of the present hot air engine has a high technical barrier, requires costly equipment, and can only achieve 25 Kw currently.

Generally, it seems that no appropriate hot air engine has been utilized in large scale with low grade temperature heat source and wasted heat. Accordingly, the present inventor has dedicated himself in the research and development of more efficient and less costly hot air engines for low grade temperature heat sources.

SUMMARY OF THE INVENTION

Therefore, a main objective of the present invention is to provide an electricity generation device that involves a low grade temperature heat source and has a simplified structure and a low production cost so as to achieve economical electricity generation.

The electricity generation device contains a closed container filled with high-pressure gas. The container has an outlet which is connected to a pneumatic or hydraulic cylinder. Hot and cold fluids are sprayed alternatively and repeatedly into the closed container to heat up or cool down the high-pressure gas. As the high-pressure gas expands, a piston rod of the cylinder is pushed forward while, as the high-pressure gas contracts, the piston rod is pulled back by a spring or a suspension object. The back and forth movement of the piston rod is then converted to rotate generator and produce electricity continuously. Also can use a linear alternator to produce electricity.

The sprayed hot or cold fluid is collected and then heated up or cooled down by a heat exchanger or a cold exchanger using a heat source (such as spring water) or a cold source (such as sea water) repeatedly.

The high-pressure gas in the closed container is one of air, hydrogen, helium, nitrogen . . . etc.

The container is made of a metallic material of high strength or a polymer material of high strength such as ultra-high molecular weight polyethylene (UHMWPE). The container could be buried in the ground and surrounding by concrete for enhanced strength and cost saving.

If there is a significant temperature difference between the heat and cold sources, one or more fluids of an intermediate temperature could be sprayed between the spray of the hot and cold fluids for enhanced efficiency.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
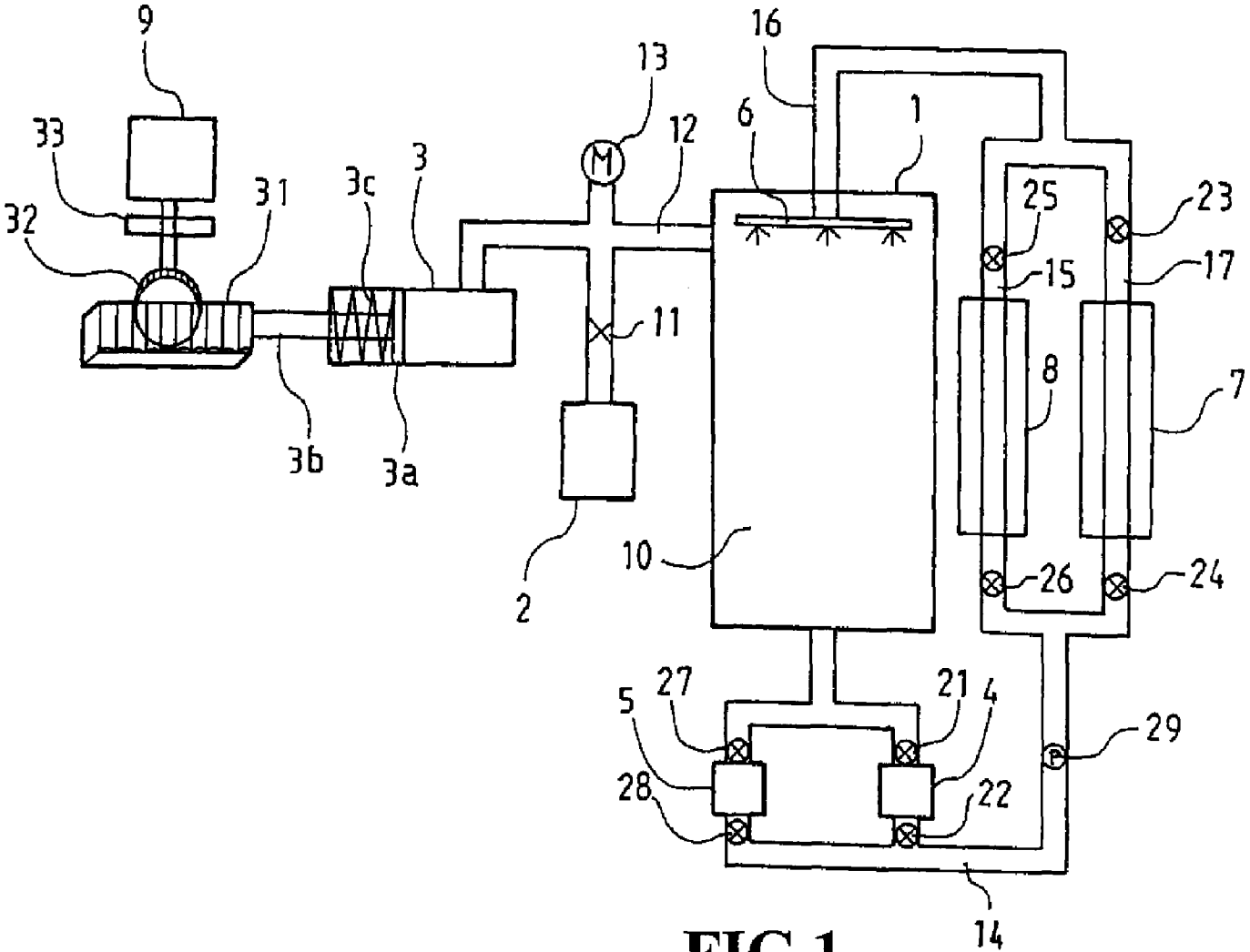
FIG. 1 is a schematic diagram showing an electricity generation device according to a first embodiment of the present invention.
Figure 2:
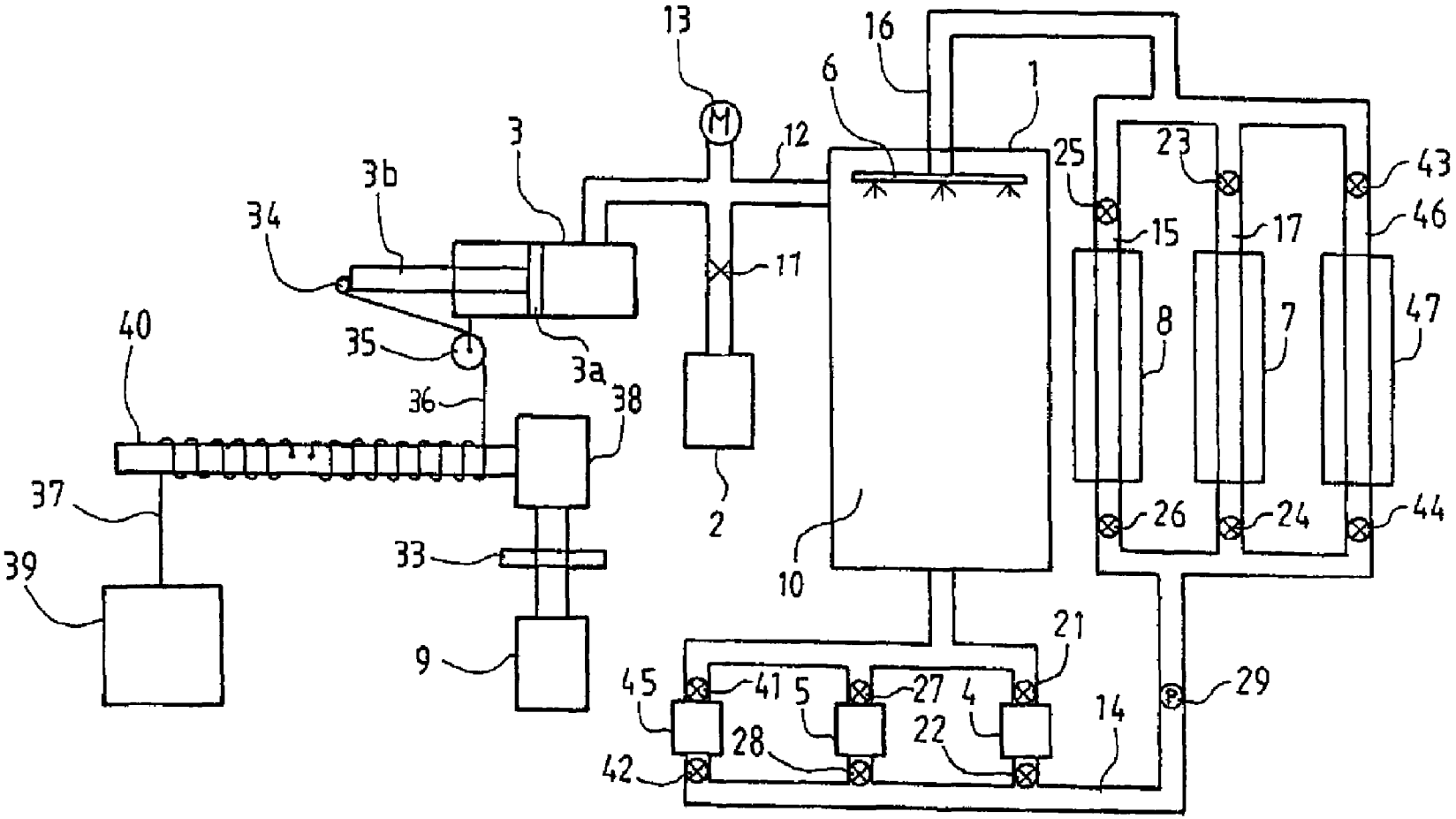
FIG. 2 is a schematic diagram showing an electricity generation device according to a second embodiment of the present invention.

FIGS. 1 and 2 depict a first embodiment and a second embodiment of the present invention. As illustrated, an electricity generation device of the present invention contains a gas container 1 where a sprinkler 6 is provided inside. A compressor 2 drives a high-pressure gas 10 into the gas container 1 through a gas valve 11 and a gas pipe 12. In the process, the gas valve 11 is closed when a pressure gauge 13 has indicated that a required pressure is reached.

The gas container 1 is connected to a hot fluid container 4 and a cold fluid container 5 in parallel, which in turn are connected to a heat exchanger 7, and a cold exchanger 8 in parallel. When the electricity generation device is in operation, solenoid valves 21, 22, 23, and 24 are opened and the hot fluid contained in the hot fluid container 4 is driven by a pump 29 to flow through fluid pipes 14, 17, and 16 to the sprinkler 6 inside the gas container 1. The hot fluid, as being continuously heated by the heat exchanger 7, is sprayed by the sprinkler 6 to heat up the high-pressure gas 10. The heated high-pressure gas 10 expands and flows into a pneumatic cylinder 3 to drive its piston 3*a* and piston rod 3*b* forward. There are plenty of means to convert such kinetic force into electrical energy and these means all have pros and cons. In the present embodiment shown in FIG. 1, the conversion means involves engaging a gear rack 31 by the piston rod 3*b* and the gear rack 31 in turn drives a ratchet gear 32 interfacing with the gear rack 31. The ratchet gear 32 then drives a generator 9 to produce electricity.

When the piston 3*a* is pushed to its end position, the solenoid valves 21, 22, 23, and 24 are automatically closed while solenoid valves 25, 26, 27, and 28 are automatically opened. As such, the cold fluid contained in the cold fluid container 5 is driven by the pump 29 to flow through fluid pipes 14, 15, and 16 to the sprinkler 6 inside the gas container 1. The cold fluid, as being continuously cooled by the cold exchanger 8, is sprayed by the sprinkler 6 to cool down the high-pressure gas 10. The cooled high-pressure gas 10 contracts and a spring 3*c* in the pneumatic cylinder 3 pulls the piston rod 3*b* and the gear rack 31 backward. Please note, due to the ratchet of the ratchet gear 32, a flywheel 33 of the generator 9 would keep the generator 9 running in the same direction due to the flywheel 33's stored inertial energy, just like a bicycle which would continue to run forward when pedaled clockwise.

As the piston rod 3*b* is moved back to its original position, the solenoid valves 21, 22, 23, and 24 are automatically opened while solenoid valves 25, 26, 27, and 28 are automatically closed, and the foregoing process would repeat itself indefinitely to continuously produce electricity.

The sprinkler 6 can be design by automatic rotating from the kinetic energy of flowing fluid.

Since the gas container 1 has to accommodate high-pressure gas 10, it has to be made of a metallic material of high strength or of polymer material of high strength such as ultra-high molecular weight polyethylene (UHMWPE). The gas container 1 could also be buried in the ground and surrounding by concrete for enhanced strength.

The heat exchanger 7 could use hot fluids such as hot spring, exhaust water from power plant, water heated by solar panel, surface ocean water, etc. from various heat sources for heating up. The cold exchanger 8, on the other hand, could use cold fluids such as river water, sea water, deep ocean water, etc. from various cold sources to cooling down. If there is a significant temperature difference between the heat and cold sources such as the wasted heat, a fluid of an intermediate temperature could be sprayed between the spray of the hot and cold fluids as shown in FIG. 2. The fluid of an intermediate temperature is contained in a container 45 and the operations of the various solenoid valves are as follows:

| Step | Valve opened | Valve closed | Fluid sprayed | State of gas | Piston movement |
|---|---|---|---|---|---|
| 1 | 21, 22, 23, 24 | 25, 26, 27, 28<br>41, 42, 43, 44 | Hot fluid | Expansion | Forward |
| 2 | 41, 42, 43, 44 | 21, 22, 23, 24<br>25, 26, 27, 28 | Fluid of intermediate temp. | Contraction | Backward |
| 3 | 25, 26, 27, 28 | 21, 22, 23, 24<br>41, 42, 43, 44 | Cold fluid | Contraction | Backward |
| 4 | 41, 42, 43, 44 | 21, 22, 23, 24<br>25, 26, 27, 28 | Fluid of intermediate temp. | Expansion | Forward |
| 5 | | | Same as step 1 | | |

From step 4 to step 5 in the above table, the high-pressure gas 10 has been heated to the intermediate temperature and the fluid in the container 45 would have a temperature in the middle between the hot and cold fluids. Therefore, the exchanger 47 shown in the drawing actually is not required, and it is shown there to simplify explanation. This second embodiment would only consume half of the thermal energy of the previous first embodiment. In other words, this second embodiment could its efficiency doubled.

FIG. 2 also shows another means to convert piston rod 3*b*'s kinetic force into electrical energy. As illustrated, a fixed wheel 34 is configured on a front end of the piston rod 3*b* so as to pull an end of a steel cable 36 or other materials cable. The other end of the steel cable 36 is fixedly wound around an axle 40. When the piston rod 3*b* moves forward, the steel cable 36 is pulled to spin the axle 40 through a fixed pulley 35. The rotational energy is then used to drive the generator 9 to produce electricity. Additionally, a speed change gear box 38 could be used between the axle 40 and the generator 9 to increase the rotational speed and the efficiency of the generator 9.

The spring 3*c* shown in FIG. 1 is replaced by a suspension object 39 in the present embodiment. When the axle 40 is turned, a steel cable 37 is rolled to pull up the suspension object 39. When the high-pressure gas 10 cools down and contracts, the suspension object 39 drops and the axle is turned in an opposite direction to roll up the steel cable 36. The piston rod 3*b* is thereby pulled back to its original position. The speed change gear box 38 also contains a ratchet so that the flywheel 33 could keep the generator 9 to run in the same direction to continuously produce electricity.

Figure 3:
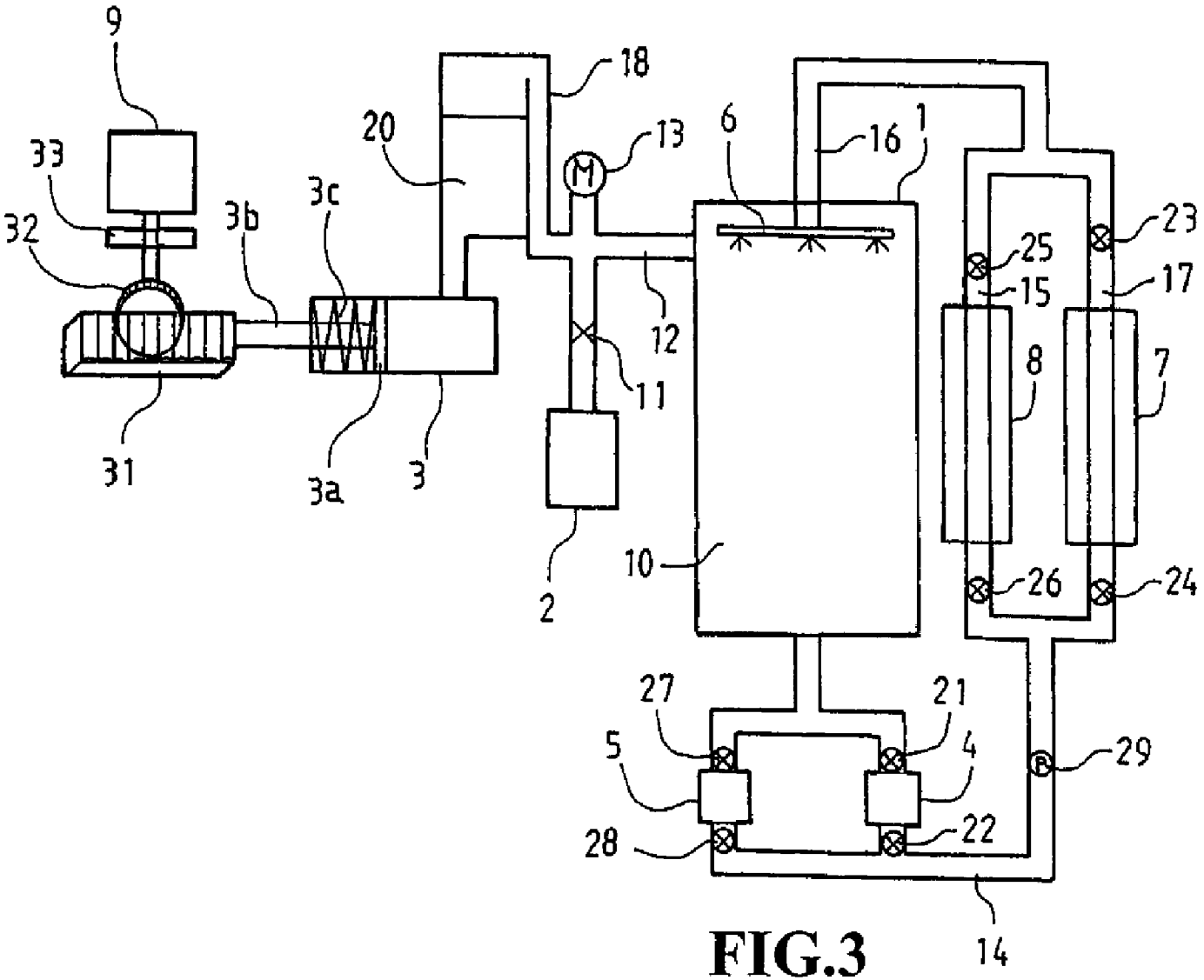
FIG. 3 is a schematic diagram showing an electricity generation device according to a third embodiment of the present invention.

FIG. 3 shows a third embodiment of the present invention, which uses a hydraulic cylinder to replace the pneumatic cylinder 3 of the previous embodiments. As illustrated, an oil gas container 18 is provided where oil 20 is filled in. When the high-pressure gas 10 expands or contracts, oil 20 is compressed or released to push or pull the piston 3*a*.

Figure 4:
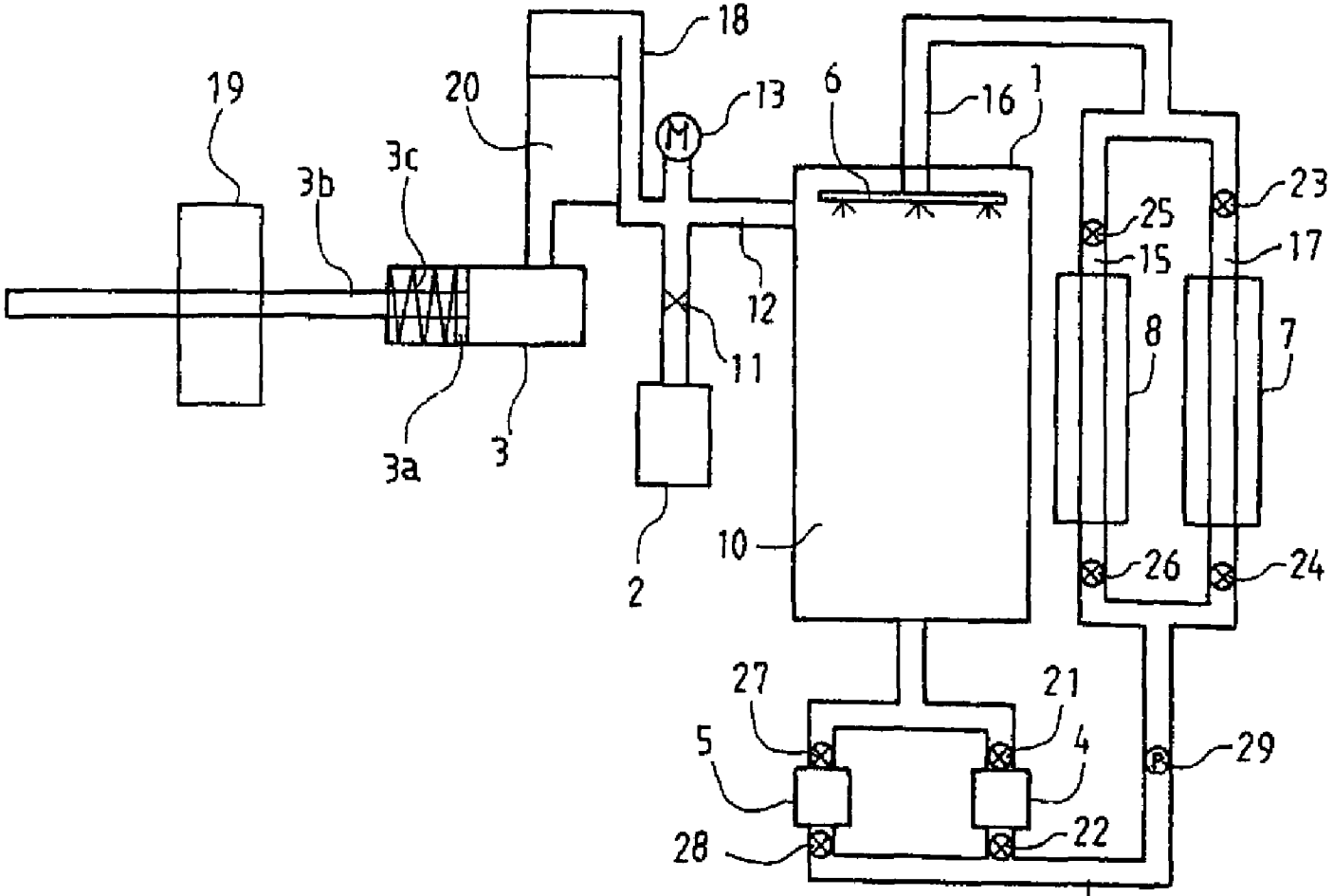
FIG. 4 is a schematic diagram showing to replace rotating type alternator by linear alternator.

FIG. 4 shows the 19 linear alternator which will convert the reciprocating motion of 3*b* piston rod directly into electricity.

As described, the present invention connects pneumatic or hydraulic cylinder to a closed container filled with high-pressure gas. Then, hot and cold fluids are sprayed alternatively and repeatedly into the closed container to heat up or cool down the high-pressure gas. As the high-pressure gas expands or contracts, a piston rod of the cylinder is pushed and pulled back and forth to produce electricity continuously.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An electricity generation device, using hot gas comprising:

a closed container that may be filled with a high-pressure gas;

a cylinder, selected from a pneumatic cylinder and a hydraulic cylinder, connected to an outlet of said closed container, and including a piston and a piston rod;

a sprinkler inside said closed container for spraying a hot fluid and a cold fluid alternately into said closed container to heat up or cool down said high-pressure gas, wherein, as said high-pressure gas expands and contracts, said piston of said cylinder is moved back and forth in a reciprocal movement;

a fixed wheel configured on an end of the piston rod;

a first cable with an end connected to the piston rod end through the fixed wheel;

an axle, wherein another end of the first cable is fixedly wound around the axle;

a fixed pulley passing the first cable from the fixed wheel to the axle; and a generator for converting said reciprocal movement of said piston into electricity; wherein when said piston rod moves forward, said first cable is pulled to spin said axle which in turn drives said generator to produce electricity.

2. The electricity generation device according to claim 1, further comprising:

a compressor for driving one of air, hydrogen, helium and nitrogen into said closed container as said high-pressure gas; and a valve between said compressor and said closed container, which is closed when a required pressure is reached.

3. The electricity generation device according to claim 1, further comprising:

a heat exchanger and a cold exchanger, wherein said hot fluid is heated up by said heat exchanger using a heat source and said cold fluid is cooled down by said cold exchanger using a cold source.

4. The electricity generation device according to claim 1, further comprising:

a pump for driving said hot and cold fluid to said sprinkler; and a plurality of solenoid valves between said pump and said sprinkler wherein, by controlling said solenoid valves on and off, said hot and cold fluid alternately sprays.

5. The electricity generation device according to claim 1, further comprising:

a second cable, a suspension object, and a flywheel connected to the generator, wherein an end of said second cable is wound around said axle while the other end of said second cable hangs said suspension object; when said axle is turned by said first cable, said second cable is rolled to pull up said suspension object; when said high-pressure gas cools down and contracts, said suspension object drops and said axle is turned in an opposite direction to roll up said first cable; said piston rod is pulled back while said flywheel of said generator keeps said generator to run in a same direction to continuously produce electricity.

6. The electricity generation device according to claim 1, further comprising:

a speed change gear box, wherein said speed change gear box is provided between said axle and said generator to increase the rotational speed and the efficiency of said generator.

7. The electricity generation device according to claim 1, further comprising:

an intermediate-temperature fluid container filled with an intermediate-temperature fluid, wherein said intermediate-temperature fluid container is provided to contain and spray an intermediate-temperature fluid between the alternate sprays of said hot and cold fluids, said intermediate-temperature fluid capable of keeping an intermediate temperature between said hot and cold fluids without heat exchanger to be sprayed for enhanced efficiency.

8. The electricity generation device according to claim 1, wherein said hydraulic cylinder includes an oil gas container having oil filled therein; when said high-pressure gas expands or contracts, said oil is compressed or released to push or pull said piston for said reciprocal movement.

9. An electricity generation device according to claim 1, wherein said sprinkler is automatically rotated as driven by a kinetic energy of a flowing fluid as sprayed into said container.

* * * * *